US005794760A

United States Patent [19]

Alexander

[11] Patent Number: 5,794,760

[45] Date of Patent: Aug. 18, 1998

[54] APPARATUS FOR LOCKING A CIRCUIT BREAKER

[76] Inventor: Richard L. Alexander, 2106 Longhorn St., Houston, Tex. 77080

[21] Appl. No.: 728,838

[22] Filed: Oct. 10, 1996

Related U.S. Application Data

[63] Continuation-in-part of Ser. No. 405,590, Mar. 7, 1995, Pat. No. 5,593,020.

[51] Int. Cl.[6] ..... H01H 9/28

[52] U.S. Cl. ..... 200/43.14; 200/43.11; 200/43.16

[58] Field of Search ..... 200/43.14, 43.11, 200/43.01, 43.15, 43.16, 43.19, 43.21; 229/324

[56] References Cited

U.S. PATENT DOCUMENTS 2,978,613 4/1961 Hein ..... 200/43.11
5,270,503 12/1993 Frye ..... 200/43.14

*Primary Examiner*—David J. Walczak
*Attorney, Agent, or Firm*—John R. Casperson

[57] ABSTRACT

Disclosed is apparatus well suited for positioning a pin to immobilize a circuit breaker switch. The apparatus comprises an elongated base member and an aperture-defining means, such as a wire or plate, fastened to the base member. The base member is elongated and has a longitudinal axis, an upper face, and a transverse groove extending across the upper face. The defining means is positioned across the transverse groove and in a plane parallel to the longitudinal axis of the base member. A portion of the aperture defined by the aperture-defining means is positioned in alignment with the transverse groove. A pin having longitudinal axis, a generally rectangular or square cross section, and a plurality of longitudinally spaced apart, circumferentially extending grooves is positioned in the groove of the base member and through a portion of the aperture to immobilize a breaker switch positioned alongside the elongated base member. A lock is also passed through the aperture to block extrication of the pin.

32 Claims, 5 Drawing Sheets

APPARATUS FOR LOCKING A CIRCUIT BREAKER

CROSS REFERENCE TO RELATED APPLICATIONS

This application is a continuation-in-part of application Ser. No. 08/405,590, filed Mar. 7, 1995, now U.S. Pat. No. 5,593,020.

BACKGROUND OF THE INVENTION

1. The Field of the Invention

In one aspect, the present invention pertains to a safety device for use with an electrical circuit breaker 2. The Prior Art There has been a continuing increase in concern for safety in industrial settings, such as all phases of manufacturing, in recent years. This concern has prompted the promulgation of many federal and state laws and regulations which are intended to improve occupational safety. In order to comply with those regulations concerning electrical power, it is now required that there must be a way to positively prevent unintentional restoration of electrical power to machinery which is either not operating or is down for service. The clear purpose of these regulations is to prevent serious injuries or death by the inadvertent supply of electrical power to or the starting of machinery which is assumed to be at least temporarily inactive or disabled. At least one of these regulations specifies that machinery be turned off and the power switch be locked in the off position.

There have been a number of devices proposed to fulfill the above discussed ends. Some of these are in the form of flags or tags which are to be placed on the handle of a circuit breaker which is to be disabled. However, these have the obvious disadvantage of being too easily removed, which could happen through inadvertence and/or oversight, and create an unintended dangerous situation. Another popular solution to this need involves rods and/or bars which pass through or engage apertures in the handles of circuit breakers. These types of solutions have the obvious disadvantage of requiring a certain type of circuit breaker, namely one with an appropriately sized and directed hole in the handle, in order to function. Use of such devices might prove to be extremely expensive in requiring either replacement of circuit breakers with one having appropriate handles or boring holes in the handle of the existing breakers. This latter case would require dismounting of the circuit breaker from the box and circuit in order to safely perform the boring operation. A further approach to the problem is to have a device which is adapted to be mounted adjacent a column of circuit breakers with circuit breaker engaging pins selectively mounted therein to engage and disable the selected circuit breaker.

OBJECTS OF THE INVENTION

It is an object of this invention to provide a safety device which provides positive locking of a wide variety of circuit breakers either in the on or off positions.

It is another object of this invention to provide a safety device which is well adapted for use with high voltage breaker boxes.

It is another object of this invention to provide a safety device which can be selected based on only a single parameter of the breaker box, the voltage.

It is another object of this invention to provide a safety device which provides universal vertical and horizontal locking alignment with the panel design of any manufacturer.

It is another object of this invention to provide a safety device which can accommodate a wide variety of breaker designs with minimal modification.

It is a further object of this invention to provide a safety device which which is easy and quick to install and can be universally interchanged because it is modular.

It is a further object of this invention to provide a safety device system which is simple and easy to use and release.

It is a further object of this invention to provide a safety device which accomplishes the foregoing objects economically.

SUMMARY OF THE INVENTION

In one embodiment of the invention, there is provided an apparatus well suited for positioning a pin to immobilize a circuit breaker switch. The apparatus comprises an elongated base member and a plate member fastened to the base member. The base member is elongated and has a longitudinal axis, an upper face, and a transverse groove extending across the upper face. The plate member is positioned across the transverse groove and in a plane parallel to the longitudinal axis of the base member. The plate member defines a transverse aperture. A portion of the aperture is positioned in alignment with the transverse groove.

In another embodiment of the invention, there is provided pin well suited for use with the just described apparatus. The has a longitudinal axis, a generally rectangular or square cross section, and a plurality of longitudinally spaced apart, circumferentially extending grooves.

In another embodiment of the invention, the above described apparatus is used in conjunction with the pin for immobilizing a selected breaker switch on a panel face having a column of breaker switches. The elongated base member is positioned alongside the column of breaker switches on the panel face with the transverse groove being in substantial alignment with the breaker switch which has been selected for immobilization. The elongated pin is positioned through the aperture and an end of the pin is aligned with the selected breaker switch. The elongated pin is then positioned in the groove and through the portion of the aperture in alignment with the groove. A shackle means is then positioned through a portion of the aperture to immobilize the pin in a position to immobilize the selected breaker switch.

Because the pin provides a mechanism for accommodating misalignments and the design uses the variety of manufacturer spacing designs one size fits all high voltage applications without regard to panel manufacturers designs or dimensions.

The groove in the elongated base member is preferably configured to closely receive the generally rectangular or square cross section of the pin, to prevent rotation of the pin around its longitudinal axis. The aperture in the plate preferably has a first portion which is positioned above the upper face of the elongated base member and is sized to permit passage of the rectangular or square cross section of the pin and to closely receive an exterior surface of the shackle means and a second aperture portion which is sized to closely receive one of the longitudinally spaced apart, circumferentially extending grooves of the pin and prevent movement of the pin along the longitudinal axis of the pin. The aperture is preferably further configured so as to position the exterior surface of the shackle means closely adjacent to the exterior surface of the pin, to prevent removal of the pin from the second aperture portion.

In another embodiment of the invention, there is provided an apparatus comprising an elongated base member and a wire loop. The elongated base member has a longitudinal axis, an upper face, a side surface, and a transverse groove extending across the upper face. The wire loop is attached to the side surface of the elongated base member and at least partially defines an aperture. A first portion of the aperture is positioned above the upper face of the base member. A second portion of the aperture is positioned in alignment with the transverse groove. The wire loop can be bent out of the way when the apparatus is not in use. By forming the wire loop from spring stock, it can automatically retract out of the way.

In yet another embodiment of the invention, there is provided a method for immobilizing a selected breaker switch on a panel face having a column of breaker switches. An elongated base member as previously described positioned on the panel face. The elongated base member is provided with a means for defining an elongated aperture across one end of the transverse groove. The defining means is movable from a retracted position which permits a panel door covering the panel face to be positioned in a closed position to an extended position wherein the means defines a first aperture portion and a second aperture portion with the second aperture portion being in axial alignment with the transverse groove of the elongated base member and positioned between the first aperture portion and the panel face. The defining means is moved to the extended position. The elongated pin which can be as previously described, is positioned and aligned. The shackle means is then positioned through the first aperture portion of the defining means to substantially immobilize the pin in a position to immobilize the selected breaker switch.

DETAILED DESCRIPTION OF THE PREFERRED EMBODIMENTS

Figure 1:
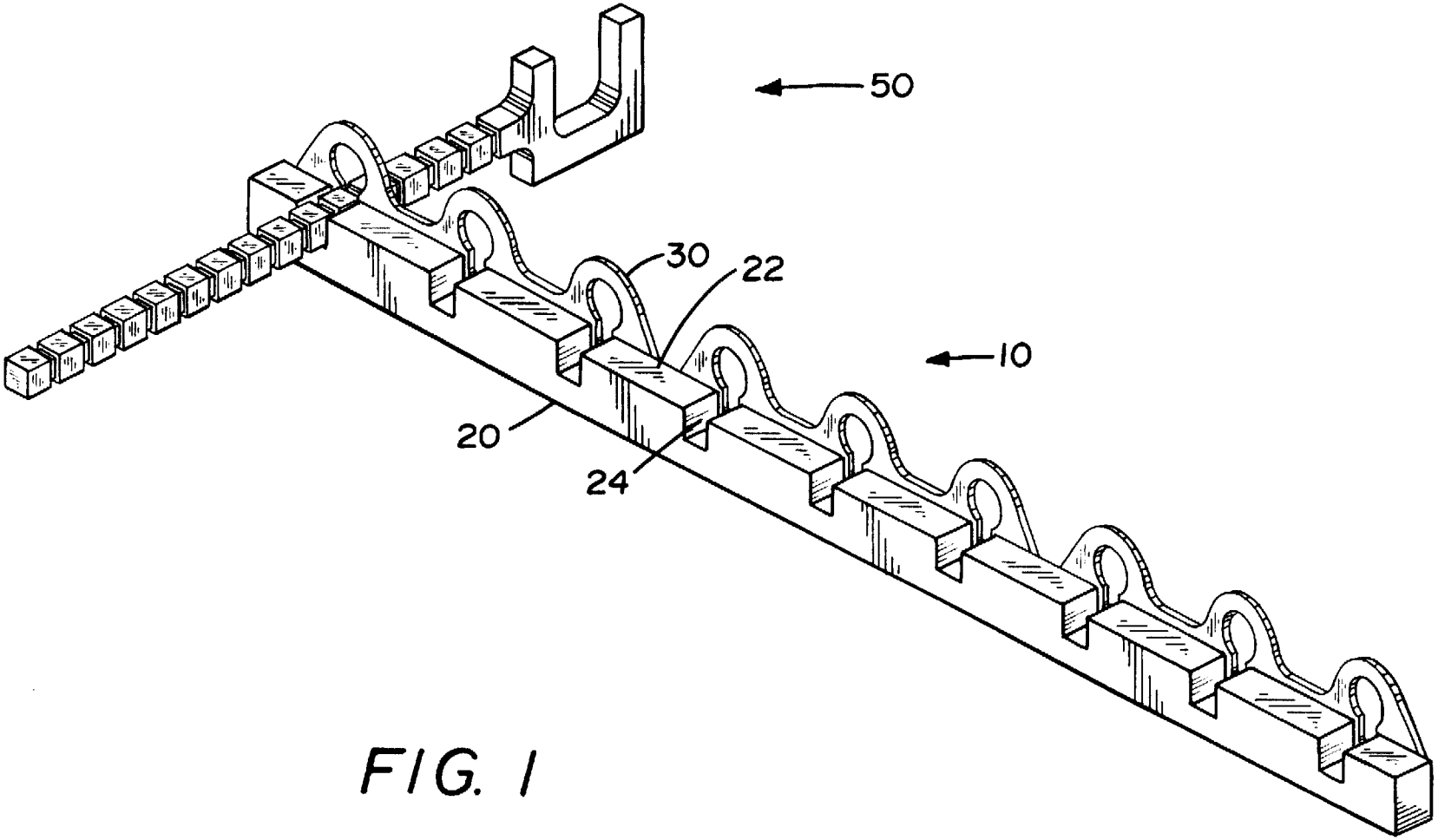
FIG. 1 is an isometric view of an assembled base member, plate and pin.
Figure 2:
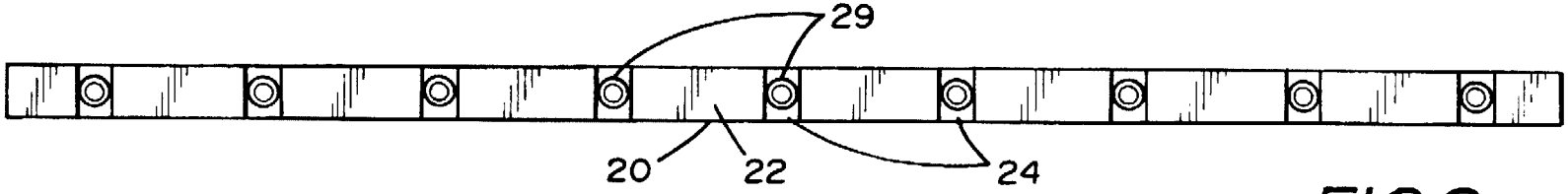
FIG. 2 is a top view of the base member shown in FIG. 1.
Figure 3:
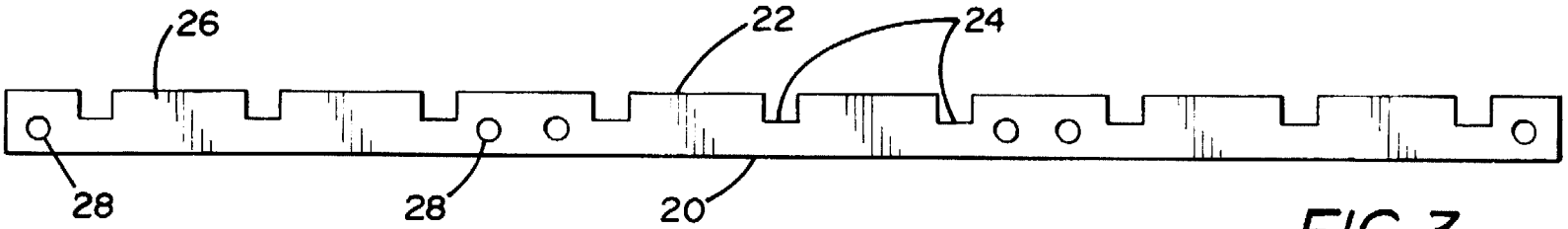
FIG. 3 is a side view of the base member shown in FIG. 1.
Figure 4:
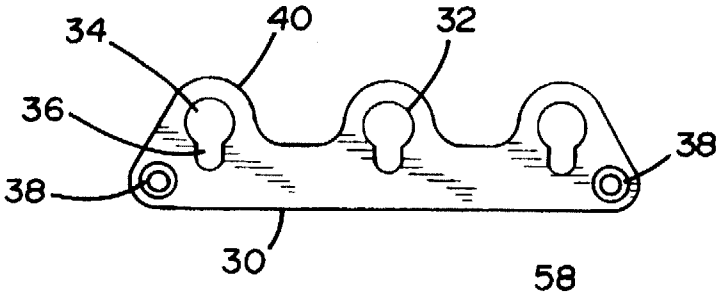
FIG. 4 is a side view of the plate shown in FIG. 1.
Figure 5:
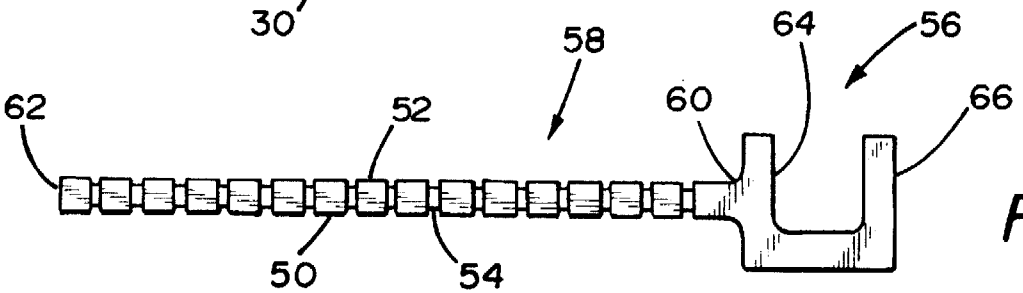
FIG. 5 is a top view of the pin shown in FIG. 1.
Figure 6:
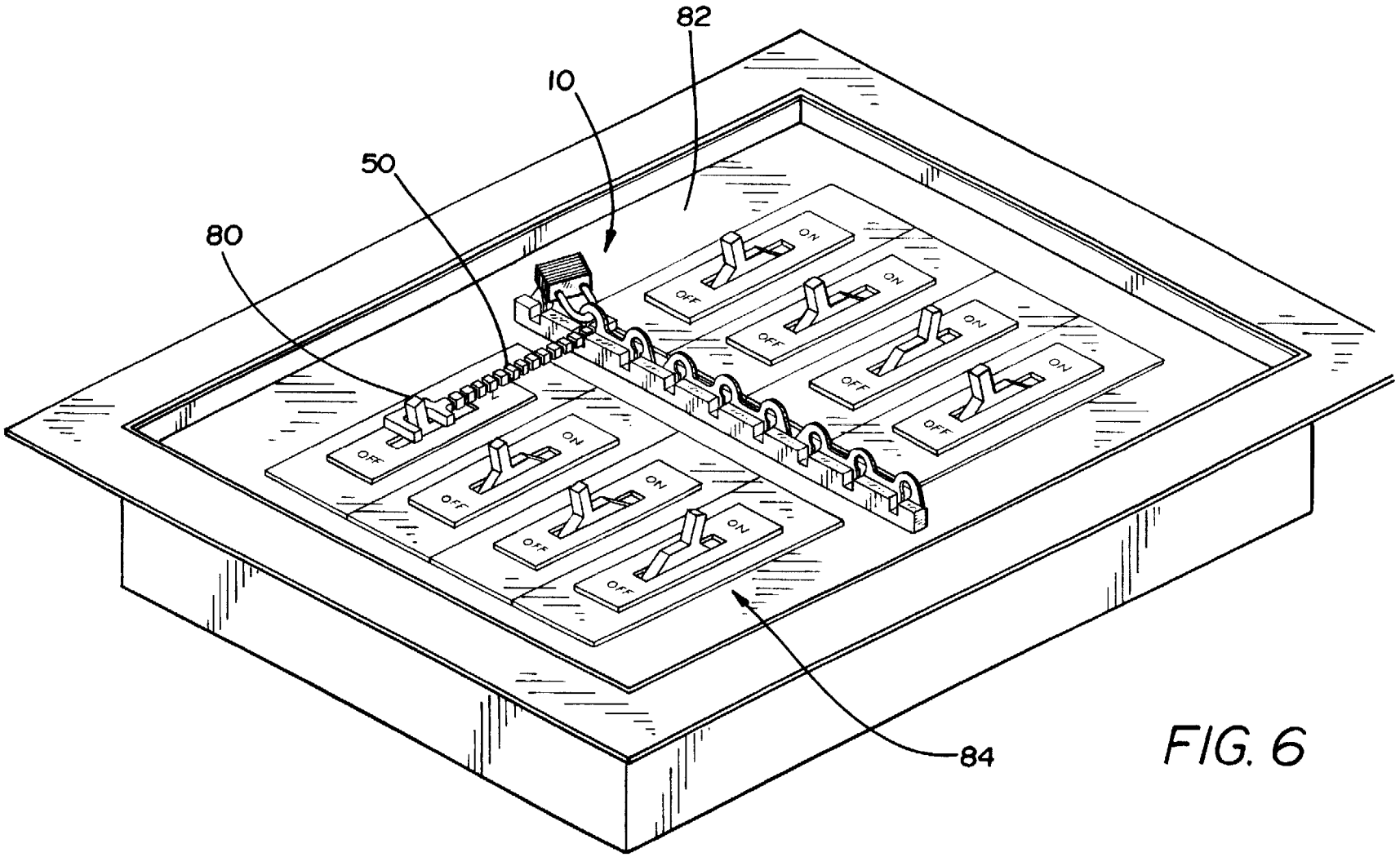
FIG. 6 is an isometric view showing an embodiment of the invention in use to immobilize a breaker switch.
Figure 7:
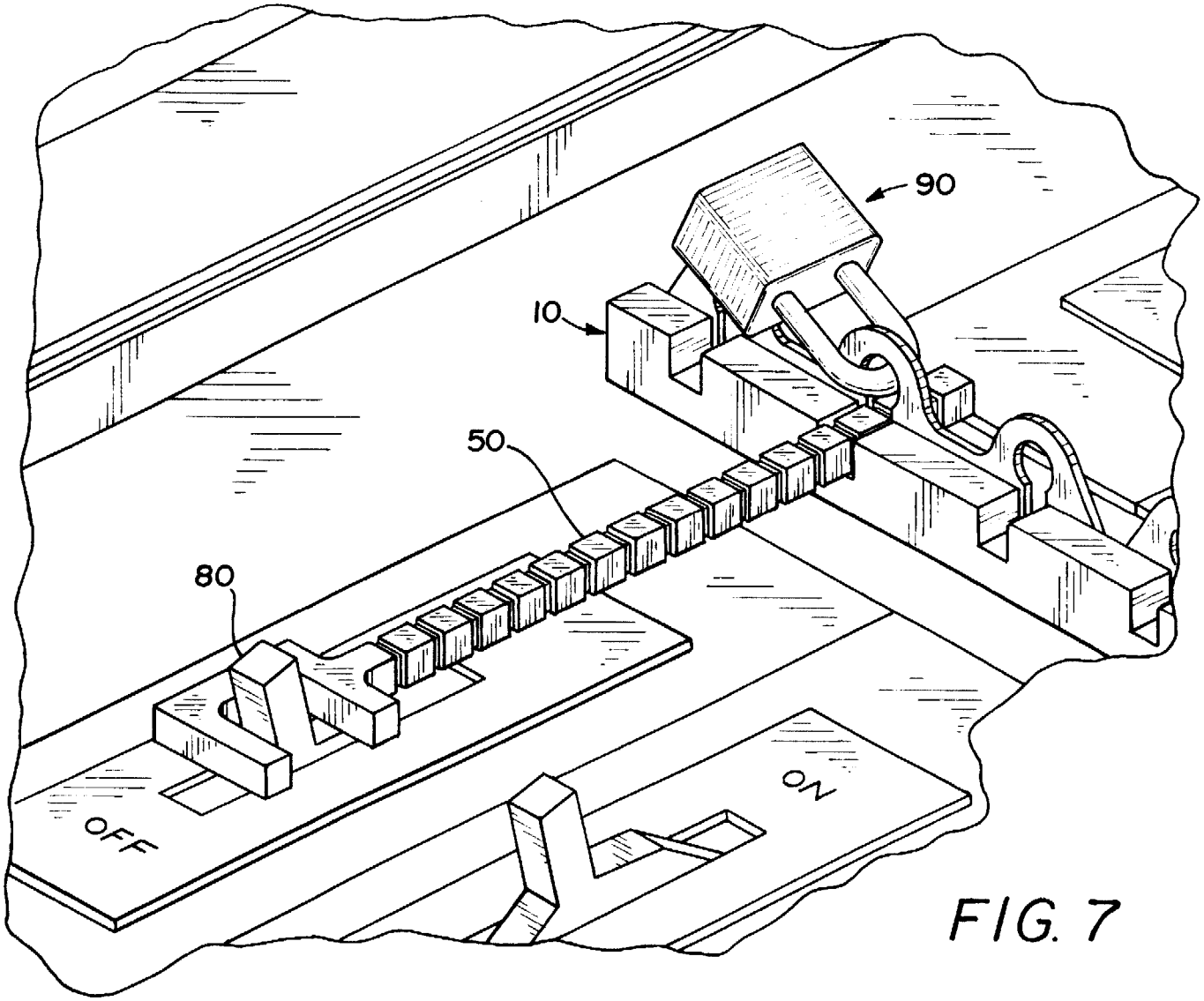
FIG. 7 is a detailed view of a portion of the device shown in FIG. 6.

In one embodiment of the invention, there is provided an apparatus 10 well suited for positioning a pin 50 to immobilize a circuit breaker switch. The apparatus comprises an elongated base member 20 and a plate member 30 fastened to the base member.

The base member 20 is elongated and has a longitudinal axis, an upper face 22, and a transverse groove 24 extending across the upper face. The elongated base member preferably has a generally planar back surface and a generally planar side surface positioned at a right angle with respect to the back surface. The base member is preferably an elongated solid block which is generally rectangular or square in section and overall appearance and is easily formed from bar stock. The upper face of the base member is preferably intersected by a plurality of parallel spaced transverse grooves defining a plurality of generally uniform preferably rectangular teeth. The base member preferably has a length to match that of a vertical column of circuit breakers and some of the grooves are preferably substantially aligned with the circuit breakers in the column, regardless of the distance between breakers. Preferably, the spacing between the grooves is equal to the spacing between the breaker switches, although selection of a wide locking pin head design and/or locking pin modification in the field can be used to accommodate misalignments. A groove spacing of 4⅞ inches will provide good results. If desired, one or more base members can be positioned alongside the column, to achieve the desired length and/or configuration. The subject invention can also be utilized with an individual circuit breaker or switch.

The plate member 30 is positioned across the transverse groove 24 and in a plane parallel to the longitudinal axis of the base member 20. The plate member defines a transverse aperture 32. A portion of the aperture is positioned in alignment with the transverse groove 24. The transverse aperture 32 in the plate member is preferably elongated and has a first aperture portion 34 positioned above the upper face of the elongated base member and a second aperture portion 36 positioned in alignment with the transverse groove 24. The first aperture portion is preferably generally circularly shaped and the second aperture portion is preferably generally slot-shaped. The first aperture portion and the second aperture portion together preferably define a generally keyhole-shaped aperture having a major axis and a minor axis. The groove 24 in the base member has a width as measured along the longitudinal axis of the base member. The second aperture portion 36 has a width as measured parallel to the minor axis of the aperture. The width of the second aperture portion is less than the width of the groove.

The plate member is preferably attached to a side surface 26 of the elongated base member 20 via suitable connecting means so that the major axis of the aperture 32 is normal to the upper face 22 of the elongated base member. This can be accomplished using screws which pass through aligned boreholes 38 in the plate member 30 and boreholes 28 in the base member 20. The boreholes are preferably parallel to the upper face 22 of the elongated base member and the boreholes 38 can be countersunk if desired.

In a preferred embodiment of the invention, the plate member 30 has an ear-shaped protrusion 40 defining an upper periphery of the first aperture portion 34. More preferably, the plate member 30 is elongated and has a plurality of transverse apertures 32, the upper periphery of each transverse aperture being defined by an ear-shaped protrusion 40 of the plate member 30. The ear shaped protrusions provide a lower profile when the apparatus is in a locked condition.

The pin 50 has a first portion 52 having exterior surface which is closely received by the selected groove 24 and a second portion 54 having an exterior surface which is closely received by the second aperture portion 36 of the plate. Receipt of the first portion of the pin in the groove prevents rotation of the pin around its longitudinal axis and receipt of the second portion of the pin by the second aperture portion of the plate and prevents movement of the pin along its longitudinal axis. Preferably, the pin 50 has a longitudinal axis which is positioned transverse to the base member in a selected groove, a generally rectangular or square cross section, and a plurality of longitudinally spaced apart, circumferentially extending grooves. The pin preferably has a generally circular cross section at the longitudinal position of the grooves, and the grooves preferably have a length as measured along the longitudinal axis of the pin which is small as compared to the width of the pin as measured transverse to the longitudinal axis of the pin. The grooves, one of which is received by the second aperture portion, define the second portion of the pin and the sections of the pin between the circumferentially extending grooves, one of which is received by the groove on the base member, define the first portion of the pin. More preferably the circumferentially extending grooves each has a length as measured longitudinally along the pin which is slightly greater than the thickness of the plate, and generally substantially less than the transverse thickness of the pin. It is preferred that the grooves in the base member have a square cross section and closely receive the pin, and be sufficiently deep so that an upper side surface of the pin will be substantially flush with an upper side surface of the base member.

In a particularly preferred embodiment of the invention, the elongated pin has a head portion 56 on one end for locking a breaker switch and a body portion 58 for receipt by the groove in the base member. The body portion 58 has a first end 60 and a second end 62 and the head portion 56 of the pin is positioned at the first end of the body portion. The head portion 56 of the pin is preferably generally "C" shaped and comprises a pair of parallel legs 64 and 66 positioned transversely to the longitudinal axis of the pin. The body portion 58 of the pin preferably connects to a mid section of one of the parallel legs of the head portion.

Many other suitable single end and double end locking pins with various end profiles or a combination of end profiles could be provided. The locking pins can also be employed without headed ends. As illustrated, the end of the locking pin has been shown provided with a rectangular hook head in the plane of the bar and opening in a direction transverse to the longitudinal axis of the bar. The bar portion of the locking pin is preferably sized for close fitting reception in the grooves of the base member which are of like shape. The locking pin is generally suitable for use with a circuit breaker or switch having a lever reset means. The locking pin shown could be profiled on both ends with like or a combination of profiles. The bar portions preferably are of sufficient length to allow the locking pin to engage a circuit breaker or switch reasonably spaced therefrom and can be trimmed in the field to such length as to prevent interference with adjacent circuit breakers and/or switches.

In use, the elongated base member is mounted on the a panel face 82 having a column 84 of breaker switches 80 positioned thereon. The elongated base member is positioned alongside the column of breaker switches. The subject device can be mounted on or adjacent to a circuit breaker or switch in a number of different ways via suitable connecting means. For example, the base member is shown with a profiled through bore 29 between each of the teeth. Flat head screws could be passed through these bores and driven into the circuit breaker box or the mounting adjacent thereto. Alternatively, the circuit breaker box could be provided with spaced and aligned studs the ends of which are received through bores in the base member and secured thereto by non-reversing push pin clips of known design. The studs would preferably be welded to the circuit breaker box or mounting. It would also be possible to mount the subject invention using any of the well known adhesives which are commercially available.

The present invention would be mounted in approximate alignment with a circuit breaker and alongside the column of breaker switches in any of the above described fashions. The subject circuit breaker safety device would be positioned with the grooves of the base member substantially aligned with the handles, levers or reset buttons of corresponding circuit breakers. In order to lock the position of any circuit breaker or combination of circuit breakers, the lock would be removed from the lock plate and an appropriate locking pin would be selected for insertion into a groove in substantial alignment with the circuit breaker in point. The selected locking pin would be adjusted for the correct length, if necessary, and inserted into the first aperture portion and over the selected groove in alignment with the circuit breaker to be disabled. The locking pin would be placed with the elongated body in the groove of the base member with the circumferential groove of the locking pin being closely received by the second aperture portion. The head of the locking pin which is preferably an integral circuit breaker engaging head, would be positioned for engaging a respective handle or lever of the circuit breaker in such fashion as to prevent the movement thereof A shackle means 90, such as the shackle of a padlock, would then be passed through the first aperture portion of the plate. Preferably, the shackle means 90 has an exterior surface which is preferably closely received by the first aperture portion of the plate and is preferably positioned closely adjacent to the exterior surface of the pin, to substantially immobilize the pin in a position to immobilize the selected breaker switch.

In a typical embodiment the base member would be manufactured in sufficient modular lengths to protect one or a plurality of circuit breakers. Since the design of the subject invention is substantially continuous, it is readily field modified should a short device be needed and only a longer one available on site. In this case the base member would be cut through at a selected groove to the desired length, for example to provide a base member having four to a dozen transverse grooves in parallel spaced relation along the upper face thereof. Regardless of the selected length, in a preferred embodiment, at least two of the grooves should have centrally located countersunk mounting bores therein.

The locking pin is each shown with a single profiled end. These pins could easily be cut to length, should there not be adequate room for the unneeded portion of the bars. In the alternative, a locking pin could be made double ended by having a bar of fixed length with the same or different profiles on the opposite ends thereof. Such a locking pin would be placed to simultaneously engage a pair of circuit breakers, each spaced from an opposite side of the subject device.

The subject circuit breaker safety device provides for positively locking circuit breakers and/or switches in a manner that conforms to the most severe regulatory commission requirements for strength, visual assurance, simplicity of installation and training, and ease of selection and use, while providing the most dependable safety possible. The present circuit breaker safety device can be used, not only for locking switches in the off position, but also for locking circuits that might be safety, security, or conservation oriented in the on position.

The subject circuit breaker safety device has a low overall profile that allows the door of a circuit breaker box or panel to be closed when locking system is not in use. It is also readily field adaptable for columns of circuit breakers of various lengths. Most importantly, the subject safety device can be used with circuit breakers or switches which have either lever, slide or toggle reset means.

Standard selection and measurement techniques can be used with the present invention for selection of the proper safety device for a high voltage panel or breaker size up to 600 v and 2000 amps. The present invention does not compromise state or national safety codes and regulations and can provide warning notice for each panel to provide assistance in operation. These notices can be used for surveying, identifying, and recording all circuits and their use.

Figure 8:
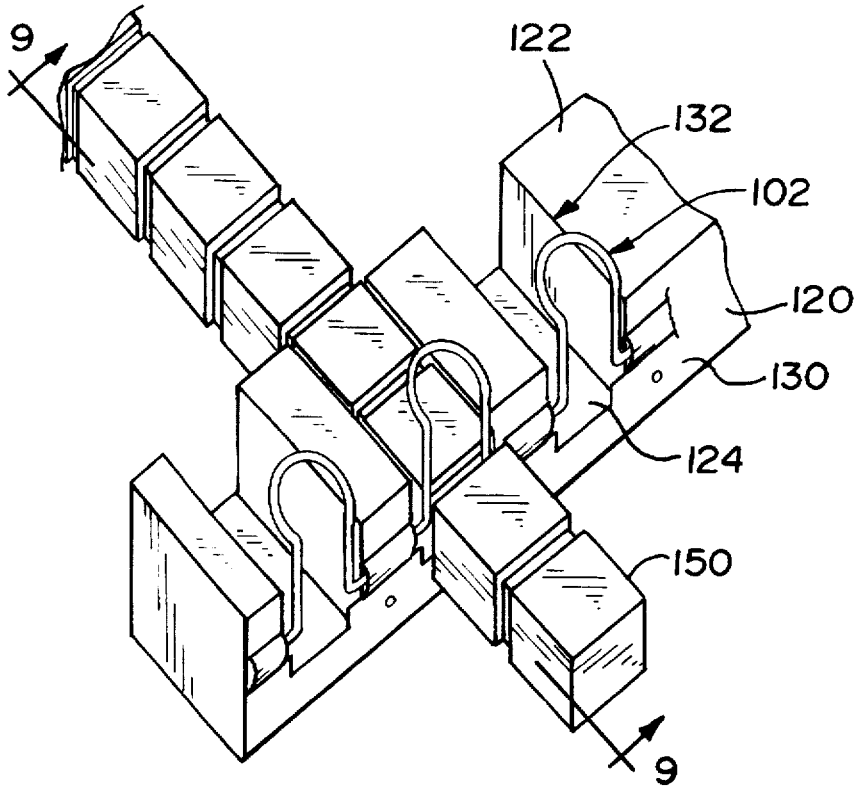
FIG. 8 is a pictorial representation of another embodiment of the invention.
Figure 9:
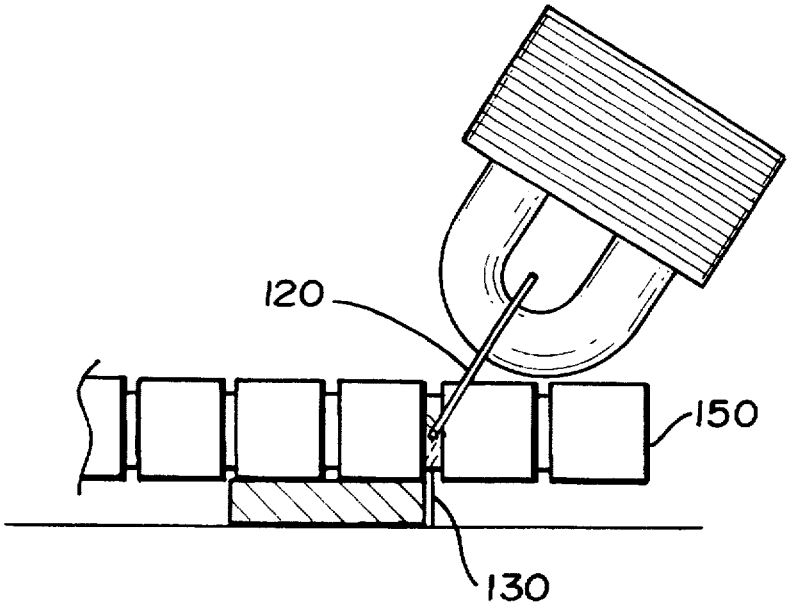
FIG. 9 is a cross sectional view of the device of FIG. 8 when viewed along cut lines 9—9.

FIGS. 8 an 9 illustrate another embodiment of the invention. The embodiment illustrated is well suited for both high voltage and low voltage applications. A wire loop 102 is attached to the side of a base member 120 in alignment with a selected transverse groove 124. When the device is not in use, the wire loop 102 can be folded against the upper face 122 of the base member 120 to permit closure of the panel door. More preferably, the wire loop 102 is formed from spring stock and has a major axis and a minor axis and has a near right angle bend across its major axis so that the loop is biased against the upper face 122 of the base member 120. The wire loop can be generally Ω-shaped or generally inverted U-shaped when viewed in the flattened configuration. The loop partially defines an aperture 132. Preferably, a first portion of the aperture is positioned above the upper face of the elongated base member and a second portion of the aperture is positioned in alignment with the transverse groove 124. The first portion of the aperture is sufficiently large to permit passage of pin 150. The second portion of the aperture is preferably sufficiently small to engage the pin 150 and prevent movement of the pin 150 along its longitudinal axis. Preferably, the pin 150 is provided with a plurality of circumferentially extending grooves each having a length which is slightly greater than the thickness of the wire. A part of the wire forming the second portion of the aperture is preferably closely received by a selected groove to immobilize the pin against movement along its longitudinal axis. If desired, a plate 130 can be used to secure the wire loop alongside the base member. For example, the wire loop can be clamped against the base member by the plate 130, which can be attached to the base member by screws. A portion of the plate can engage with a groove in the pin in a manner analogous to earlier described embodiments of the invention.

In use, the wire loop is lifted off the top surface of the base member and the pin is passed through the first portion of the aperture formed by the loop until the pin is in the desired position with respect to the switch to be immobilized. The pin then positioned in the second portion of the aperture and the groove of the base member and a portion of the wire and/or plate is engaged with a selected groove in the pin to immobilize the pin against movement along its longitudinal axis. A lock shackle which is sized to be closely received by the first portion of the aperture is then passed through the first portion of the aperture to prevent extrication of the pin.

The present invention may be subject to many modifications and changes without departing from the spirit or essential characteristics thereof The present embodiment should therefor be considered in all respects as illustrative and not restrictive of the scope of the present invention as defined by the appended claims.

What is claimed is:

1. Apparatus comprising:

an elongated base member having a longitudinal axis, an upper face, and a transverse groove extending across the upper face, and a plate member positioned in a plane parallel to the longitudinal axis of the base member and having a transverse aperture with a portion of the aperture positioned in alignment with the transverse groove, and means for connecting the elongated base member with the plate member, wherein the transverse aperture in the plate member is elongated and has a first aperture portion positioned above the upper face of the elongated base member and a second aperture portion positioned in alignment with the transverse groove.

2. Apparatus as in claim 1 wherein the first aperture portion is generally circularly shaped and the second aperture portion is generally slot-shaped, the first aperture portion and the second aperture portion together defining a generally keyhole-shaped aperture having a major axis and a minor axis.

3. Apparatus as in claim 2 wherein the groove in the base member has a width as measured along the longitudinal axis of the base member and the second aperture portion has a width as measured parallel to the minor axis of the aperture, the width of the second aperture portion being less than the width of the groove.

4. Apparatus as in claim 3 wherein the plate member has an ear-shaped protrusion defining an upper periphery of the first aperture portion.

5. Apparatus as in claim 4 wherein the elongated base member has a generally planar back surface and a generally planar side surface positioned at a right angle with respect to the back surface and the plate member is attached to the side surface.

6. Apparatus as in claim 5 wherein the elongated base member has a square or rectangular cross section.

7. Apparatus as in claim 6 wherein the elongated base member is formed from bar stock.

8. Apparatus as in claim 7 wherein the elongated base member has a plurality of parallel transverse grooves.

9. Apparatus as in claim 8 wherein the plate member is elongated and has a plurality of transverse apertures, an upper periphery each transverse aperture being defined by an ear-shaped protrusion of the plate member.

10. Apparatus as in claim 9 further comprising a pin having a longitudinal axis positioned transverse to the base member in a selected groove.

11. Apparatus as in claim 10 wherein the pin has a first portion positioned in the groove and a second portion positioned in the second aperture portion of the plate.

12. Apparatus as in claim 11 wherein the first portion of the pin has an exterior surface which is closely received by the selected groove and prevents rotation of the pin around its longitudinal axis and the second portion of the pin has an exterior surface which is closely received by the second aperture portion of the plate and prevents movement of the pin along its longitudinal axis.

13. Apparatus as in claim 12 wherein the first portion of the pin has a rectangular or square cross section.

14. Apparatus as in claim 13 wherein the second portion of the pin is formed by a circumferential groove in the pin, said circumferential groove having a length which is slightly greater than the thickness of the plate.

15. Apparatus as in claim 14 wherein the pin has a plurality of longitudinally spaced apart circumferential grooves and a generally square cross section.

16. Apparatus as in claim 15 wherein the grooves in the base member have a square cross section and closely receive the pin, wherein an upper side surface of the pin is substantially flush with an upper side surface of the base member.

17. Apparatus as in claim 16 further comprising a shackle means positioned through the first aperture portion of the plate, wherein the shackle means is closely received by the first aperture portion of the plate and prevents removal of the pin.

18. Apparatus as in claim 17 wherein the shackle means comprises a padlock.

19. Apparatus as in claim 18 wherein the pin has a first end and a second end and comprises an elongated body portion for receipt by the groove and a head portion for locking a breaker switch, the head portion being positioned at the first end of the pin.

20. Apparatus as in claim 19 wherein the head portion of the pin is generally "C" shaped and the head portion comprises a pair of parallel legs positioned transversely to the longitudinal axis of the pin.

21. Apparatus as in claim 20 wherein the body portion of the pin connects to a mid section of one of the parallel legs of the head portion.

22. Apparatus as in claim 21 further comprising a panel face having a column of breaker switches positioned thereon, wherein the elongated base member is mounted on the panel face alongside the column of breaker switches and the head portion of the pin engages and immobilizes a selected one of the breaker switches.

23. A method for immobilizing a selected breaker switch on a panel face having a column of breaker switches, said method comprising positioning an elongated base member alongside the column on the panel face, said elongated base member having a transverse groove across an upper face thereof in substantial alignment with the selected breaker switch and a plate across one end of the transverse groove, said plate having an elongated aperture therethrough having a first aperture portion and a second aperture portion with the second aperture portion being in axial alignment with the transverse groove of the elongated base member and positioned between the first aperture portion and the panel face;

positioning an elongated pin having a first end and a second end through the first aperture portion, wherein the elongated pin has an exterior surface which is loosely received by the first aperture portion;

aligning the first end of the pin in a position to immobilize the selected breaker switch;

positioning the elongated pin in the groove and through the second aperture portion, wherein a first portion of the pin has an exterior surface which is closely received by the selected groove and prevents rotation of the pin around its longitudinal axis and a second portion of the pin has an exterior surface which is closely received by the second aperture portion of the plate and prevents movement of the pin along its longitudinal axis; and positioning a shackle means through the first aperture portion of the plate, said shackle means having an exterior surface which is closely received by the first aperture portion of the plate and is positioned closely adjacent to the exterior surface of the pin, to substantially immobilize the pin in a position to immobilize the selected breaker switch.

24. An elongated pin for immobilizing a breaker switch, said pin having a longitudinal axis, a generally rectangular or square cross section, and a plurality of longitudinally spaced apart, circumferentially extending grooves, wherein the pin has a generally circular cross section at the longitudinal position of the grooves, and the grooves have a length as measured along the longitudinal axis of the pin which is small as compared to the width of the pin as measured transverse to the longitudinal axis of the pin, wherein the pin comprises a head portion for locking a breaker switch and a body portion, wherein the body portion has a first end and a second end and the head portion of the pin is positioned at the first end of the pin, and wherein the head portion of the pin is generally "C" shaped and the head portion comprises a pair of parallel legs positioned transversely to the longitudinal axis of the pin.

25. An elongated pin as in claim 24 wherein the body portion of the pin connects to a mid section of one of the parallel legs of the head portion.

26. Apparatus comprising an elongated base member having a longitudinal axis, an upper face, a side surface, and a transverse groove extending across the upper face, and a wire loop attached to the side surface of the elongated base member and at least partially defining an aperture with a first portion of the aperture positioned above the upper face of the elongated base member and a second portion of the aperture positioned in alignment with the transverse groove.

27. Apparatus as in claim 26 wherein the wire loop is formed from spring stock and has a major axis and a minor axis and a right angle bend across its major axis so that the wire loop is biased towards the upper face of the elongated base member.

28. Apparatus as in claim 22 wherein the wire loop is generally inverted U-shaped when viewed in the flattened configuration.

29. Apparatus as in claim 28 further comprising a pin having a longitudinal axis positioned in the transverse groove of the elongated base member and through the second portion of the aperture formed by the wire loop.

30. Apparatus as in claim 29 wherein the pin is provided with a plurality of circumferentially extending grooves and a portion of the wire loop is closely received by a selected groove of the pin to immobilize the pin against movement along the longitudinal axis of the pin.

31. Apparatus as in claim 30 further comprising a shackle means closely received by the first portion of the aperture formed by the wire loop to prevent extrication of the pin from the groove.

32. A method for immobilizing a selected breaker switch on a panel face having a column of breaker switches, said method comprising positioning an elongated base member alongside the column on the panel face, said elongated base member having a transverse groove across an upper face thereof in substantial alignment with the selected breaker switch and a means for defining an elongated aperture across one end of the transverse groove, said defining means being movable from a retracted position which permits a panel door covering the panel face to be positioned in a closed position to an extended position wherein said means defines a first aperture portion and a second aperture portion with the second aperture portion being in axial alignment with the transverse groove of the elongated base member and positioned between the first aperture portion and the panel face;

moving the defining means to the extended position;

positioning an elongated pin having a first end and a second end through the first aperture portion, wherein the elongated pin has an exterior surface which is loosely received by the first aperture portion;

aligning the first end of the pin in a position to immobilize the selected breaker switch;

positioning the elongated pin in the groove and through the second aperture portion, wherein a first portion of the pin has an exterior surface which is closely received by the selected groove and prevents rotation of the pin around its longitudinal axis and a second portion of the pin has an exterior surface which is closely received by the second aperture portion of the defining means and prevents movement of the pin along its longitudinal axis; and positioning a shackle means through the first aperture portion of the defining means, said shackle means having an exterior surface which is closely received by the first aperture portion of the defining means and is positioned closely adjacent to the exterior surface of the pin, to substantially immobilize the pin in a position to immobilize the selected breaker switch.

* * * * *